US011033771B2

(12) United States Patent
Juen

(10) Patent No.: US 11,033,771 B2
(45) Date of Patent: Jun. 15, 2021

(54) VERTICAL WEIGHT RACK

(71) Applicant: Andrew Kenneth Juen, Boynton Beach, FL (US)

(72) Inventor: Andrew Kenneth Juen, Boynton Beach, FL (US)

( * ) Notice: Subject to any disclaimer, the term of this patent is extended or adjusted under 35 U.S.C. 154(b) by 0 days.

(21) Appl. No.: 14/308,381

(22) Filed: Jun. 18, 2014

(65) Prior Publication Data

US 2014/0367351 A1 Dec. 18, 2014

Related U.S. Application Data

(60) Provisional application No. 61/836,554, filed on Jun. 18, 2013.

(51) Int. Cl.
*A63B 21/16* (2006.01)
*A63B 21/072* (2006.01)

(52) U.S. Cl.
CPC ..... *A63B 21/169* (2015.10); *A63B 21/0726* (2013.01)

(58) Field of Classification Search
CPC ..... A47B 81/005; A47B 88/20; A47F 7/0035; A47F 5/08; A47F 5/0884; A47F 7/0028; A47F 7/0021; A47F 7/005; A47F 7/0007; A63B 71/0036; A63B 21/072
USPC ..... 211/86.01, 119.001, 119.004, 88.04, 6, 211/16, 49.1, 85.5, 193, 18, 70.6, 87.01, 211/75, 69, 70.8, 60.1, 64, 85.7; 248/224.8, 339, 690, 304, 301; 206/372–378, 477, 481, 483, 489
See application file for complete search history.

(56) References Cited

U.S. PATENT DOCUMENTS

D150,797 S * 8/1948 Lane ..... D6/468
D180,106 S * 4/1957 Seifert ..... D6/468
2,797,851 A * 7/1957 Leake ..... 224/482
2,946,452 A * 7/1960 Caloiero et al. ..... 211/4
3,081,056 A * 3/1963 Sweet et al. ..... 248/552
3,288,304 A * 11/1966 Graves ..... 211/64
D218,616 S * 9/1970 Owen ..... D6/468
3,731,817 A * 5/1973 Fowlkes et al. ..... 211/70.8
4,310,094 A * 1/1982 Hotchkiss, Jr. ..... 211/70.6
4,648,516 A * 3/1987 Elkins ..... A47B 81/005 211/64
4,705,168 A * 11/1987 Ward ..... 206/373
4,776,471 A * 10/1988 Elkins ..... A47B 57/52 211/64
D319,361 S * 8/1991 Moser ..... D7/701
D337,466 S * 7/1993 Moser ..... D6/570
D339,946 S * 10/1993 Moser ..... D6/570
5,431,074 A * 7/1995 Durante ..... 81/462
D362,776 S * 10/1995 Thorn ..... D6/552
5,505,316 A * 4/1996 Lee ..... 211/70.6
5,638,964 A * 6/1997 Ernst ..... 211/70.6
D392,489 S * 3/1998 Ernst ..... D6/571
(Continued)

*Primary Examiner* — Jennifer E. Novosad
(74) *Attorney, Agent, or Firm* — Gary L. Eastman, Esq.; EastmanIP

(57) ABSTRACT

A weight rack having an elongated base is provided. The base may include a front side and a rear side. The base may include a height that is substantially greater than a width. Protruding from the front side of the base includes a plurality of U-shaped cradles. The U-shaped cradles may be oriented along the height of the elongated base. Each of the U-shaped cradles may be formed to receive and secure a dumbbell.

5 Claims, 5 Drawing Sheets

(56) References Cited

U.S. PATENT DOCUMENTS

| | | | | | |
|---|---|---|---|---|---|
| 5,924,964 | A * | 7/1999 | Hayden | A63B 21/078 | 482/104 |
| D424,141 | S * | 5/2000 | Eckmann | D21/686 | |
| 6,293,412 | B1 * | 9/2001 | Draper | E05B 73/00 | 211/4 |
| 6,315,121 | B1 * | 11/2001 | Hansen | 206/376 | |
| D455,310 | S * | 4/2002 | Webber | D21/686 | |
| 6,390,309 | B1 * | 5/2002 | Tucker | B63B 32/80 | 211/85.7 |
| D469,293 | S * | 1/2003 | Harms | D6/552 | |
| D469,294 | S * | 1/2003 | Harms et al. | D6/552 | |
| 6,932,224 | B1 * | 8/2005 | Sandberg | 211/70.8 | |
| D528,612 | S * | 9/2006 | Black | D21/686 | |
| 7,178,670 | B2 * | 2/2007 | Chen | 206/376 | |
| D543,078 | S * | 5/2007 | Davalos | D7/701 | |
| D555,961 | S * | 11/2007 | Lien et al. | D6/552 | |
| 7,678,030 | B2 * | 3/2010 | Savage | A63B 71/0036 | 482/104 |
| 8,210,366 | B2 * | 7/2012 | Kahn | A47F 7/00 | 211/85.7 |
| 8,403,155 | B1 * | 3/2013 | Kao | 211/70.6 | |
| 8,596,590 | B2 * | 12/2013 | McCoy | 248/68.1 | |
| 8,973,766 | B2 * | 3/2015 | Sprang, Jr. | 211/70.6 | |
| 9,156,393 | B2 * | 10/2015 | Sprang, Jr. | B60P 7/0823 | |
| 2005/0009671 | A1 * | 1/2005 | Hummer, Jr. | A63B 21/078 | 482/94 |
| 2005/0051445 | A1 * | 3/2005 | Meehan | A45C 11/00 | 206/372 |
| 2009/0211996 | A1 * | 8/2009 | Webber | A63B 71/0036 | 211/85.7 |
| 2009/0218302 | A1 * | 9/2009 | Winnard | 211/70.6 | |
| 2014/0367351 | A1 * | 12/2014 | Juen | A63B 21/0726 | 211/85.7 |

* cited by examiner

VERTICAL WEIGHT RACK

CROSS-REFERENCE TO RELATED APPLICATION

This application claims the benefit of priority of U.S. provisional application No. 61/836,554, filed Jun. 18, 2013, the contents of which are herein incorporated by reference.

BACKGROUND OF THE INVENTION

The present invention relates to a weight rack and, more particularly, to a vertical weight rack that attaches to a surface.

Generally, a standard gymnasium, fitness studios and country clubs with gyms provides dumbbells for their patrons to use for weight lifting. Dumbbells require racks to keep the different weights organized and to prevent injury due to tripping over dumbbells on the floor. Currently, floor racks are utilized to store dumbbells. However, floor racks take up a lot of space. For example, the floor racks may take up between 10 to 30 square feet of usable floor space. Fitness studios, country clubs and gyms need as much usable space for their patrons as possible. By removing standard dumbbell racks, the facility may gain valuable floor space that it otherwise would not have.

As can be seen, there is a need for a weight rack that saves space.

SUMMARY OF THE INVENTION

In one aspect of the present invention, a weight rack comprises: an elongated base comprising a front side and a rear side, wherein the elongated base comprises a height substantially greater than a width; and a plurality of U-shaped cradles protruding from the front side of the elongated base, wherein the plurality of U-shaped cradles are oriented along the height of the elongated base, wherein each of the plurality of U-shaped cradles is formed to receive and secure a dumbbell.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention may include a wall mounted storage system for dumbbells. The present invention may include a U-channel that may be made of a metal such as steel or aluminum. The U-shaped channel may cradle the dumbbells handle or head. The present invention provides the storage of dumbbells utilizing a wall instead of a traditional dumbbell rack which takes up valuable space. The present invention takes up little floor space by mounting the racks on the wall, which allows for more efficiency and comfort for the patrons.

Figure 1:
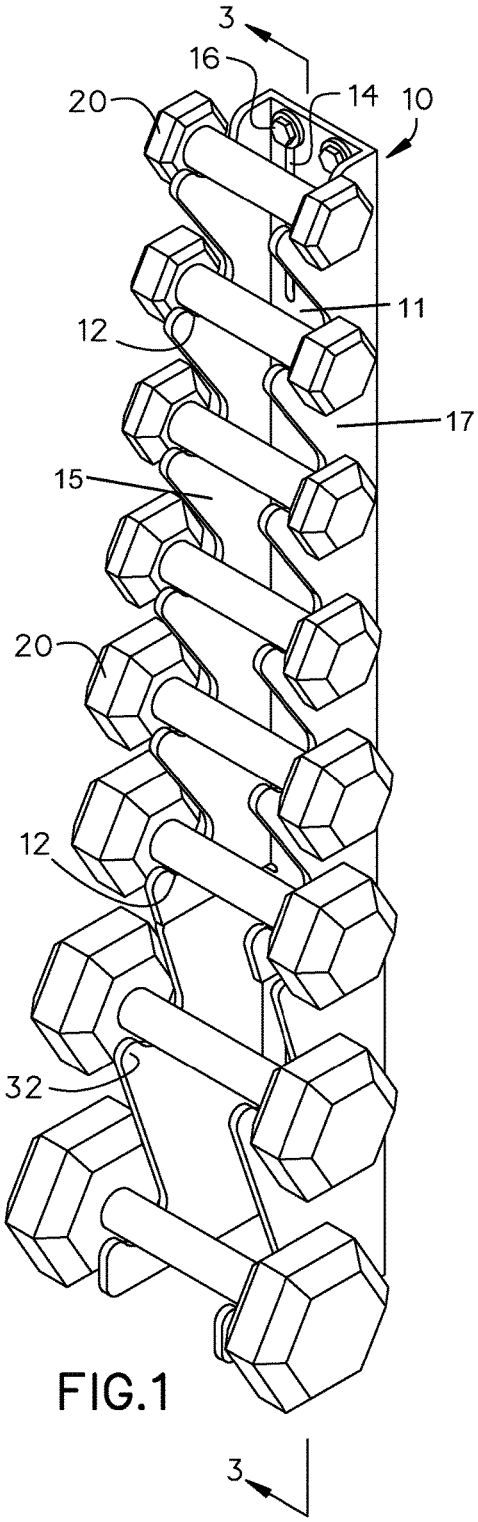
FIG. 1 is a perspective view of the present invention shown in use.
Figure 2:
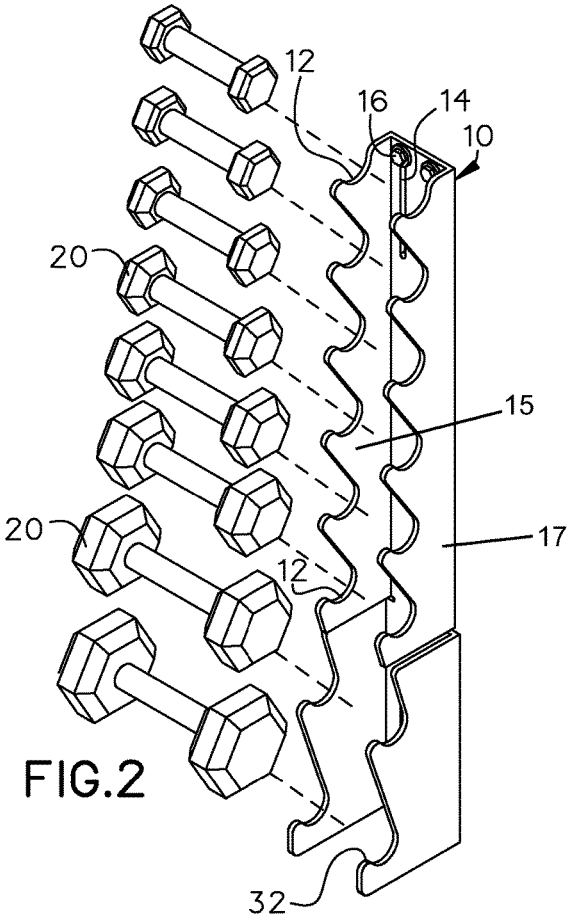
FIG. 2 is an exploded view of the in-use present invention.
Figure 3:
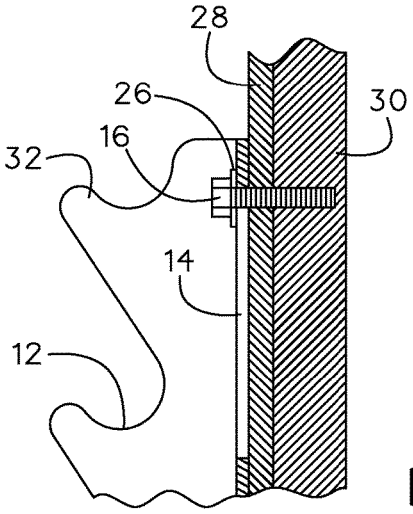
FIG. 3 is a detail section view of the present invention along line 3-3 in FIG. 1.
Figure 4:
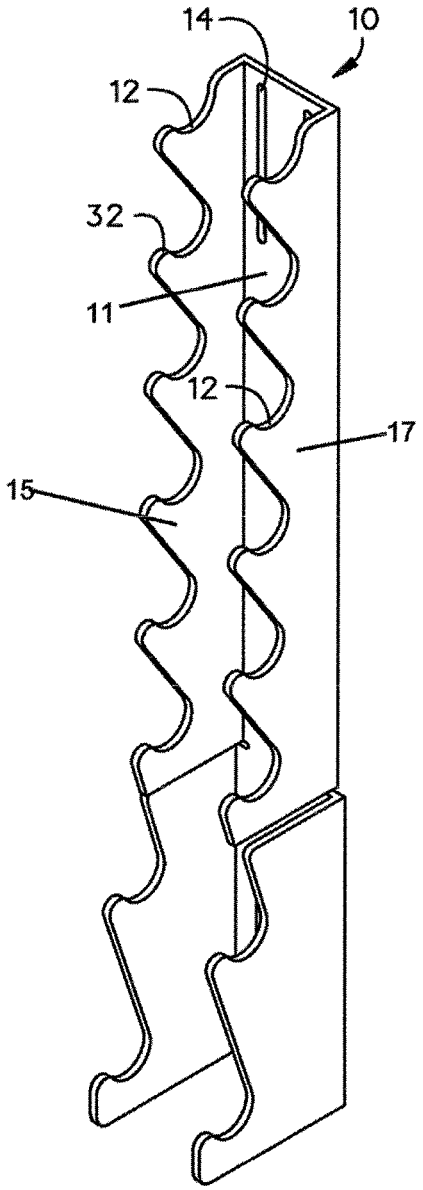
FIG. 4 is a perspective view of the present invention.
Figure 5:
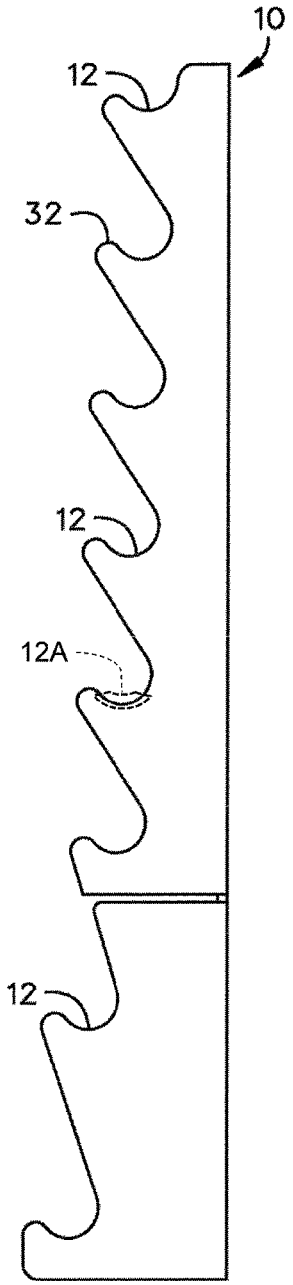
FIG. 5 is a side view of the present invention.
Figure 6:
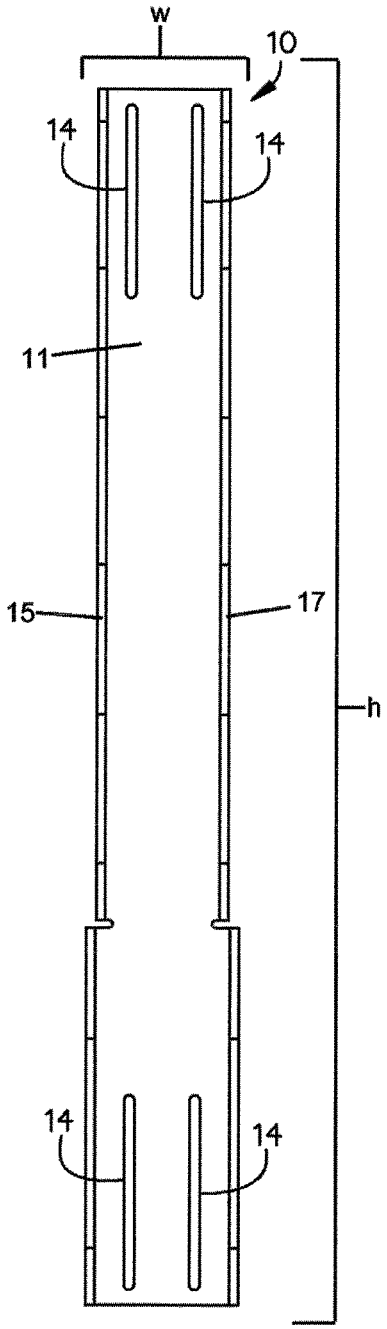
FIG. 6 is a front view of the present invention.
Figure 7:
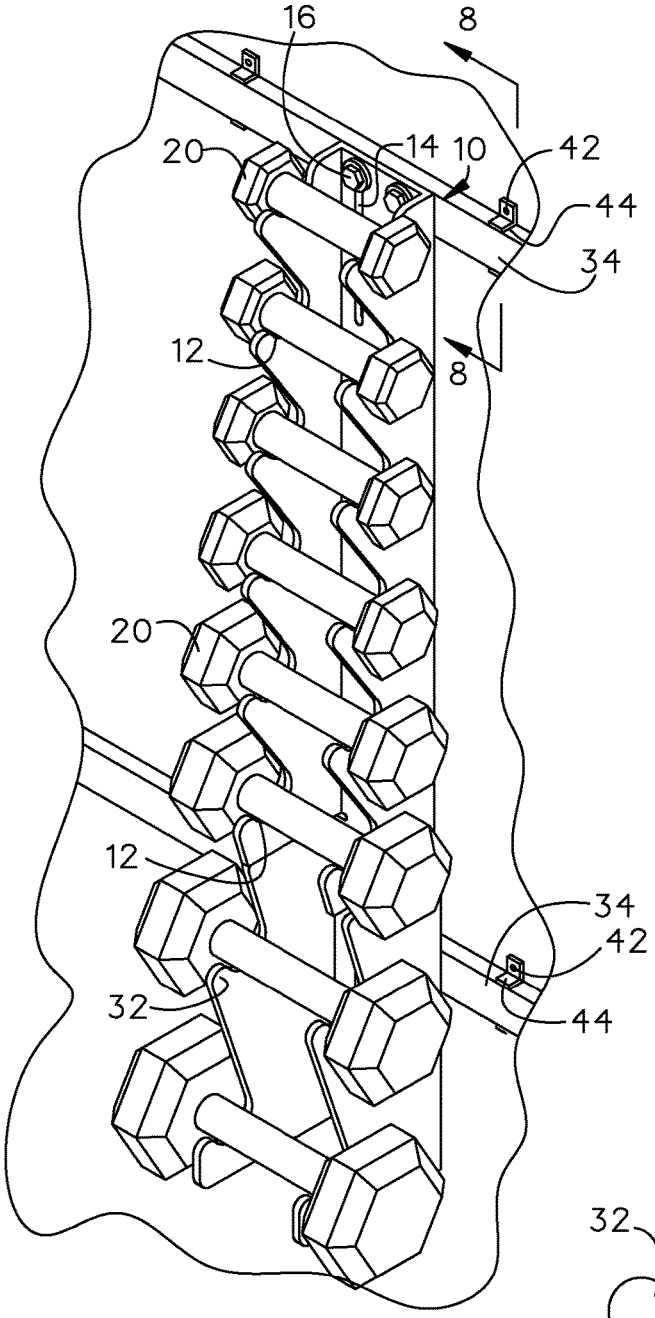
FIG. 7 is a perspective view of an alternate embodiment of the present invention.
Figure 8:
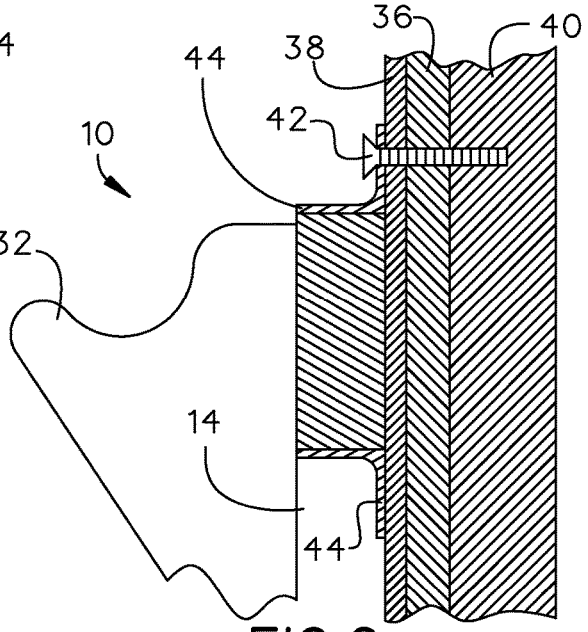
FIG. 8 is a section detail view of an alternate embodiment of the present invention along line 8-8 in FIG. 7.
Figure 9:
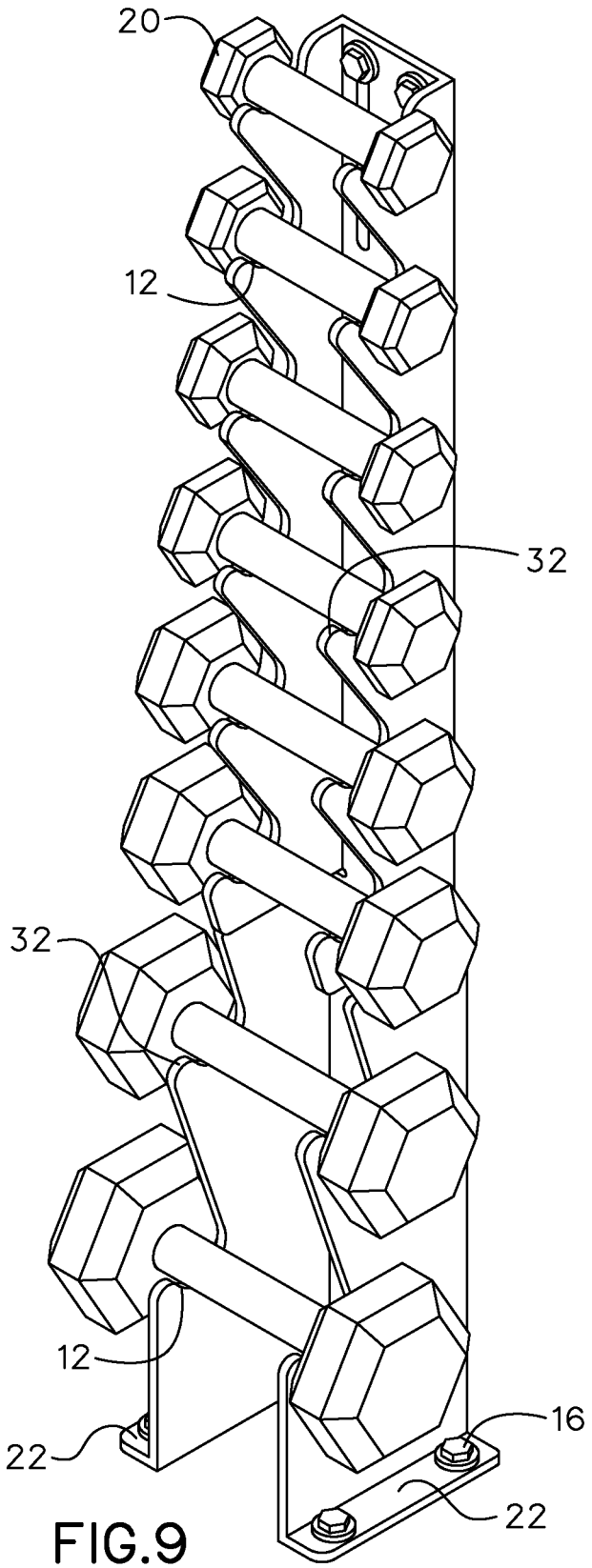
FIG. 9 is a perspective view of an alternate embodiment of the present invention shown in use.
Figure 10:
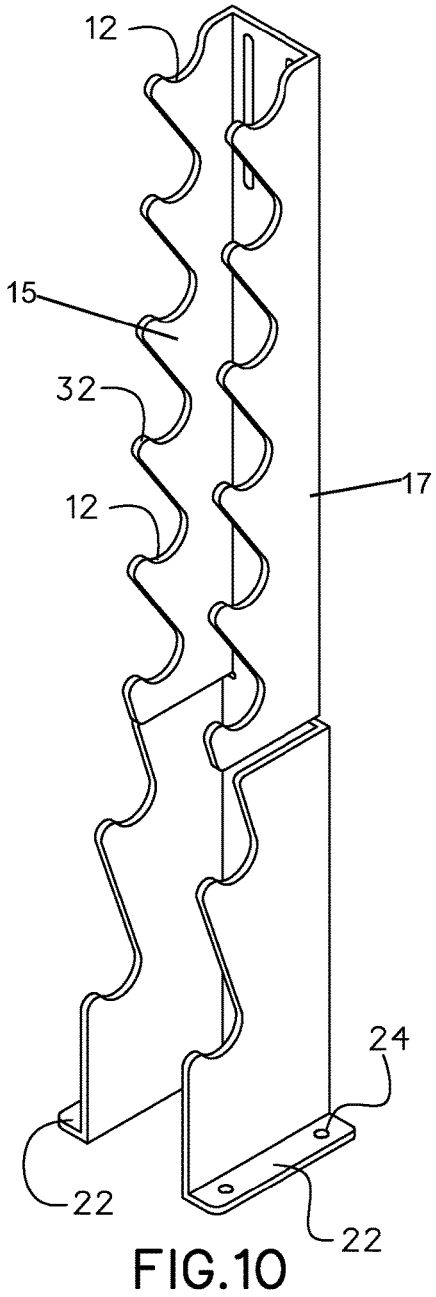
FIG. 10 is a perspective view of an alternate embodiment of the present invention.
Figure 11:
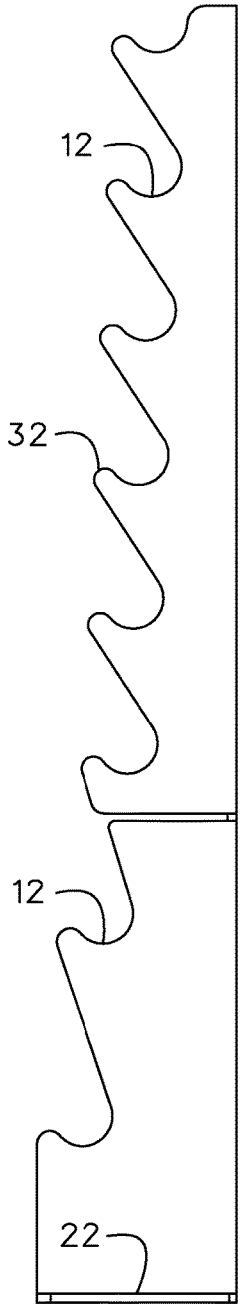
FIG. 11 is a side view of an alternate embodiment of the present invention.
Figure 12:
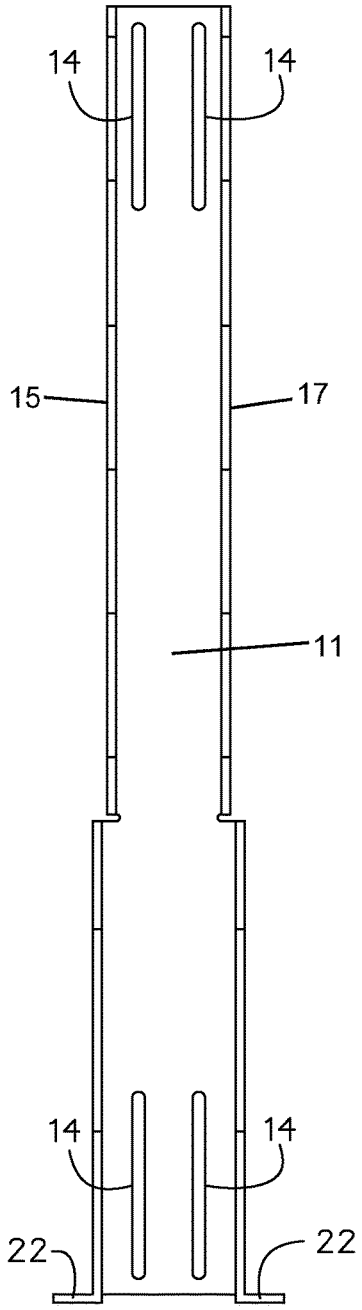
FIG. 12 is a front view of an alternate embodiment of the present invention.

Referring to FIGS. 1 through 12, the present invention includes a weight rack 10 having an elongated base 11. The base 11 may include a front side and a rear side. The base 11 may include a height (h) that is substantially greater than width (w). Protruding from the front side of the base 11 includes a plurality of U-shaped cradles 32. The U-shaped cradles 32 may be oriented along the height of the elongated base 11. Each of the U-shaped cradles 32 may be formed to receive and secure a dumbbell 20.

In certain embodiments, the rear side of the elongated base 11 may be substantially flat and may be mounted directly to a wall 28 by a connector. In such embodiments, the elongated base 11 may include a plurality of slots 14 running through the front side and the rear side. The connector may include a plurality of bolts 16 that run through the slots 14 and into the wall 28 and stud 30. Washers 26 may be used to help secure the elongated base 11 to the wall 28.

The weight rack 10 of the present invention may further be mounted to a support mount 34 by the bolts 16. The support mount 34 may include an aluminum extruded support mount 34. The support mount 34 may be mounted to plywood 38, which is attached to a rubber material 36, which may be attached to a metal stud 40. The support mount 34 may be attached to the plywood 38 by a bracket 44 and screw fasteners 42.

The present invention may further include a first side 15 and a second side 17 protruding from the front side of the base 11. A plurality of aligning channels 12 are formed on the first side and the second side forming the plurality of U-shaped cradles 32. The plurality of U-shaped cradles 32 may align vertically with one another along the height of the elongated base 11.

In certain embodiments, the first side 15 and the second side 17 include a top portion and a bottom portion. As illustrated in the FIGS. 4 through 6, the first side 15 and the second side 17 may have a greater length at the bottom portion than at the top portion. Further, a distance between the first side 15 and the second side 17 may be greater at the bottom portion than the top portion. The increased dimensions of the bottom portion may accommodate for larger sized and weighted dumbbells 20.

The weight rack 10 of the present invention may be bolted to the ground surface. In such embodiments, a first flange 22 may extend from the first side 15 of the bottom portion, and a second flange 22 may extend from the second side 17 of the bottom portion. The first and second flange 22 may each include a slot 24. A bolt 16 may be inserted into the slot and bolted to the ground, thereby securing the weight rack 10 to the surface.

There may be multiple configurations of the present invention. For example, there may be a weight rack 10 that holds three pairs of dumbbells 20 that have head diameters of six inches or less. There may also be a weight rack 10 that holds four pairs of dumbbells 20 with head diameters of under four inches. The space between the handle cradles 20 may determine the amount and type of dumbbell that may be stored.

In certain embodiments, the racks 10 may be manufactured out of sheet aluminum or steel. The flat design may be laser cut, or water-jet cut, then bent into shape to form the U shape. Plastic, rubber, or foam guards 12A may be placed within the channels 12 to protect the U-shaped cradles 32.

It should be understood, of course, that the foregoing relates to exemplary embodiments of the invention and that modifications may be made without departing from the spirit and scope of the invention as set forth in the following claims.

What is claimed is:

1. A weight rack comprising:

an elongated base comprising a planar front side opposite a planar rear side, wherein the elongated base comprises a height substantially greater than a width;

a plurality of U-shaped cradles protruding from the front side of the elongated base oriented along the height of the elongated base, wherein each U-shaped cradle is formed with a guard positioned within each said cradle;

a plurality of slots formed through the elongated base;

a plurality of fasteners sized to fit within the slots and configured to secure the elongated base to a wall;

a plurality of dumbbells each retained within one of the plurality of U-shaped cradles; and a first side and a second side protruding from the front side of the base wherein a plurality of aligning channels are formed on the first side and the second side forming the plurality of U-shaped cradles;

wherein each of the first side and the second side comprises a top portion and a bottom portion wherein the first side and the second side have a greater length at the bottom portion than at the top portion.

2. The weight rack of claim 1, further comprising a first flange extending from the first side of the bottom portion, and a second flange extending from the second side of the bottom portion.

3. The weight rack of claim 2, wherein the first flange and the second flange each comprises at least one slot configured to receive a bolt to be attached to a surface.

4. The weight rack of claim 1, wherein the distance between the first side and the second side is greater at the bottom portion than the top portion.

5. The weight rack of claim 1, wherein the plurality of U-shaped cradles align vertically with one another along the height of the elongated base.

* * * * *